US005263889A

United States Patent [19]

Ledonne

[11] Patent Number: 5,263,889

[45] Date of Patent: Nov. 23, 1993

[54] MULTICOMPARTMENT PINATA

[76] Inventor: Vincent J. Ledonne, 7442 Capps Ave., Reseda, Calif. 91335

[21] Appl. No.: 992,464

[22] Filed: Dec. 17, 1992

[51] Int. Cl.[5] ..... A63H 33/00; A63H 3/00; A63H 33/30; B65D 85/00

[52] U.S. Cl. ..... 446/5; 446/73; 446/75; 446/475; 206/526; 206/579; 229/239

[58] Field of Search ..... 206/526, 579; 229/120.03, 238, 239; 446/4, 5, 69, 71, 72, 73, 75, 79, 475, 487, 486, 227, 228; 273/440, 445; 434/259

[56] References Cited

U.S. PATENT DOCUMENTS

| | | | |
|---|---|---|---|
| 546,333 | 9/1895 | Kell | 446/227 X |
| 4,435,915 | 3/1984 | Zarube et al. | 446/75 |
| 4,496,652 | 9/1987 | Reeder et al. | 446/75 |
| 4,787,872 | 11/1988 | Bajo | 446/5 |
| 4,819,817 | 4/1989 | Mar | 446/227 X |
| 4,950,194 | 8/1990 | Gullace | 446/72 |
| 4,968,279 | 11/1990 | Smith | 446/71 |
| 5,118,318 | 6/1992 | Lorizio | 446/72 |

FOREIGN PATENT DOCUMENTS

| | | | |
|---|---|---|---|
| 1010589 | 11/1965 | United Kingdom | 446/73 |

*Primary Examiner*—David N. Muir
*Attorney, Agent, or Firm*—Robert M. Sperry

[57] ABSTRACT

An improved pinata which is reusable and comprises a generally cylindrical housing having a plurality of compartments formed therein to releasably retain a quantity of candy and having trap door means individually actuable to release the contents of a respective one of said compartments, together with a plurality of resilient latches disposed about the exterior of said housing and individually actuable to selectably release a gift retained by the respective latches.

8 Claims, 2 Drawing Sheets

MULTICOMPARTMENT PINATA

BACKGROUND

1. Field of Invention

This invention relates to pinatas and is particularly directed to improved pinatas are reusable and which carry a plurality of selectable prize packages and which can accommodate a variety of different sized packages.

2. Prior Art

Pinatas have long been popular for distributing gifts at children's parties and the like. Traditional pinatas have been formed of frangible material and the participants have been blindfolded and have struck the pinata with sticks to break the pinata and, thus, obtain the candy or other gifts contained within the pinata. Unfortunately, breaking the pinata obviously precludes reuse of the pinata for subsequent occasions. Furthermore, small children often have insufficient strength to break the pinata, whereas when larger children are involved, swinging of the stick by the blindfolded child often results in injury to other children standing nearby. Numerous types of reusable pinatas have been proposed heretofore to overcome these problems. However many of the prior art reusable pinatas have been expensive to purchase and have been complex to assemble and operate. Other prior art reusable pinatas have failed to desirably control release of the gifts and have either dumped the gifts prematurely or have failed to release the gifts when triggered. Still other prior art pinatas have been designed to accommodate only a single size or type of candy or gift and have not be able to accommodate other types or sizes. A search in the United States Patent Office has revealed the following:

| U.S. Pat. No. | INVENTOR | ISSUED |
|---|---|---|
| 4,167,078 | R. M. Oquita | Sep. 11, 1979 |
| 4,253,266 | R. Bajo | Mar. 3, 1981 |
| 4,787,872 | R. Bajo | Nov. 29, 1988 |
| 4,832,337 | L. I. Estrada | May 23, 1989 |

Each of these references is subject to the disadvantages discussed above. Thus, none of the prior art pinatas have been entirely satisfactory.

BRIEF SUMMARY AND OBJECTS OF INVENTION

The disadvantages of prior art pinatas are overcome with the present invention and an improved pinata is provided which is reusable and which is inexpensive to purchase, yet which can accommodate a variety of types and sizes of gifts and which is selectably triggerable to release desired gifts.

These advantages of the present invention are preferably attained by providing an improved pinata which is reusable and comprises a housing having a plurality of compartments formed therein to releasably retain a quantity of candy and having trap door means individually actuable to release the contents of a respective one of said compartments, together with a plurality of resilient latch means disposed about the exterior of said housing and individually actuable to selectably release a gift retained by the respective latch means.

Accordingly, it is an object of the present invention to provide an improved pinata.

Another object of the present invention is to provide an improved pinata which is reusable.

An additional object of the present invention is to provide an improved pinata which can accommodate a variety of types and sizes of gifts.

A further object of the present invention is to provide an improved pinata having a plurality of compartments which are individually triggerable to release the contents thereof.

Another object of the present invention is to provide an improved pinata having means for mounting a plurality of gifts about the exterior thereof together with means for individually and selectably releasing said gifts.

An additional object of the present invention is to provide an improved pinata which is inexpensive to purchase.

A specific object of the present invention is to provide an improved pinata which is reusable and comprises a housing having a plurality of compartments formed therein to releasably retain a quantity of candy and having trap door means individually actuable to release the contents of a respective one of said compartments, together with a plurality of resilient latch means disposed about the exterior of said housing and individually actuable to selectably release a gift retained by the respective latch means.

These and other objects and features of the present invention will be apparent from the following detailed description, taken with reference to the figures of the accompanying drawings.

DETAILED DESCRIPTION OF THE INVENTION

Figure 1:
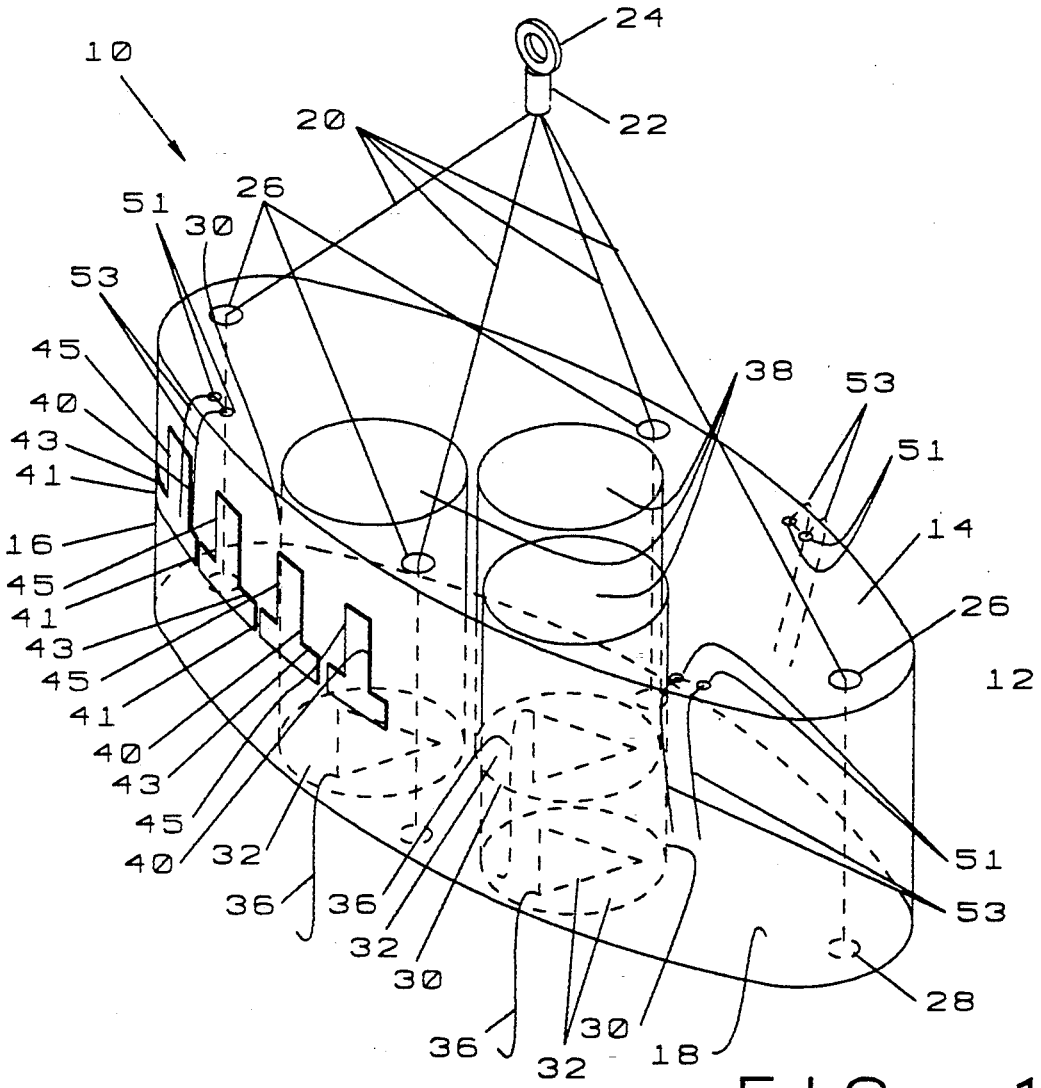
FIG. 1 is a diagrammatic representation of a pinata embodying the present invention.
Figure 2:
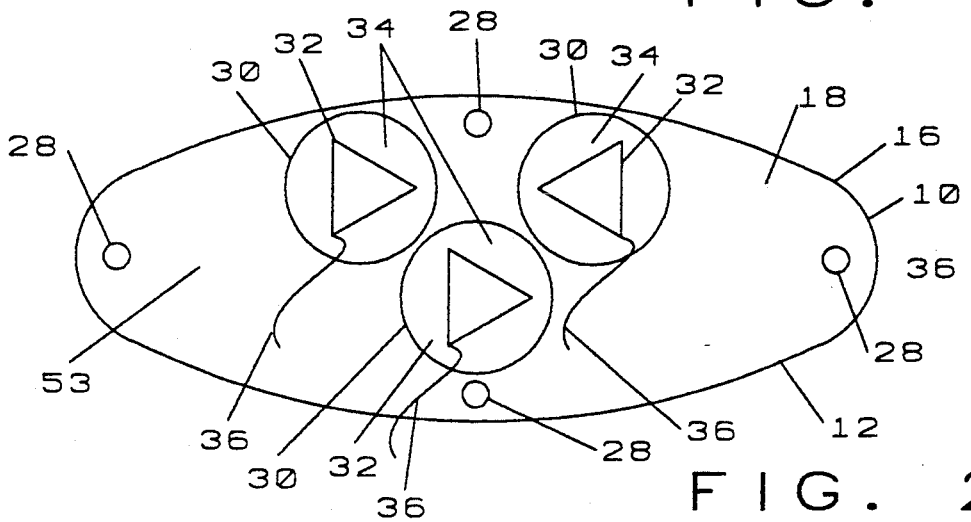
FIG. 2 is a bottom view of the pinata of FIG. 1.
Figure 3:
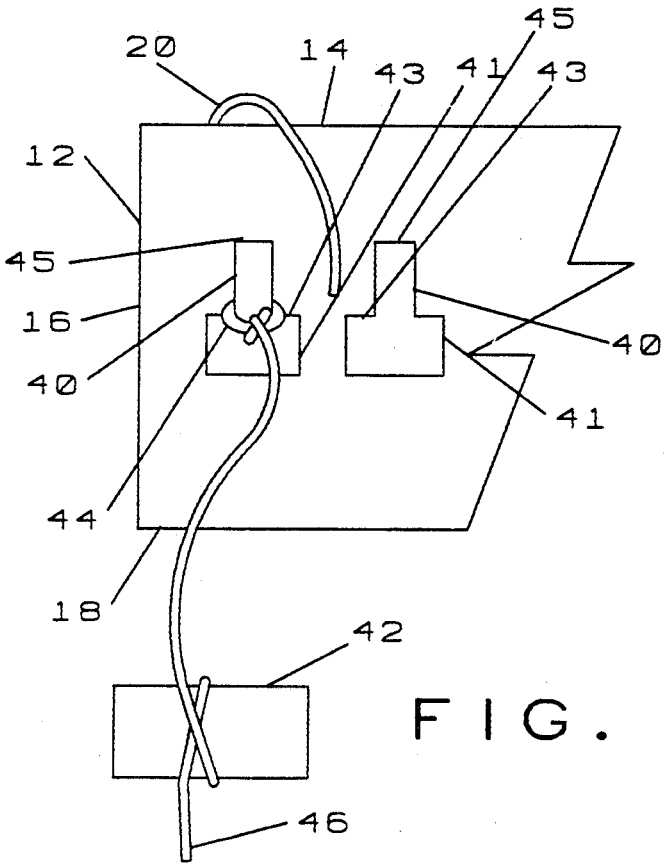
FIG. 3 is a partial side view showing a gift attached to one of the hooks on the sidewall of the housing of the pinata of FIG. 1.

In that form of the present invention chosen for purposes of illustration in the drawing, FIG. 1 shows a pinata, indicated generally at 10, having a generally hollow housing 12, of substantially any desired shape, formed with a lid 14, an annular sidewall 16 and a bottom 18. To suspend the pinata 10 for use, a plurality of strings 20 are provided, each having one end connected to suitable attachment means, such as swivel 22 and hook 24, while the opposite end of each of the strings 20 passes through a suitable opening 26 in the lid 14 and is attached to the bottom 18 as seen at 28 in FIG. 1. Within the housing 12, one or more cylindrical containers 30 are provided to releasably retain a quantity of candy or the like, and each of the containers 30 is formed with a trap door 32 formed in the bottom 34 of the container 30. The trap door 32 is releasably secured in the closed position and is actuable by suitable triggering means, such as strings 36, which are each attached to a respective one of the trap doors 32 and which each serve to open the respective trap door 32 and to release the contents of the respective container 30. The tops 38 of the containers 30 may be open or closed, as desired. About the side wall 16, a plurality of hooks 40 are provided to allow additional gifts to be suspended from the sidewall 16 of the housing 12, as seen at 42 in FIG. 3. These gifts 42 may be wrapped or not, at the option of the user, but each of the gifts 42 is releasably secured to a respective one of the hooks 40 by suitable trigger means, such as rings 44 with strings 46 hanging from the rings 44. As seen in FIGS. 1 and 3, the hooks 40 may be formed by suitable cuts 41 in the sidewall 16 of the housing 12. As seen in FIGS. 1 and 3, the cuts 41, forming the hooks 40, are preferably shouldered, as seen at 43, having a central projection 45 extending upward from the shoulder 43. The participant may release the gifts 42 simply pulling on the string 46, causing the rings 44 to force the central projection 45 to be bent outward and downward to release the ring 44, while the shoulders 43 prevent the rings 44 from sliding too far down on the hooks 40, where downward pressure on the rings 46 would be ineffective to release the hooks 40. Preferably, however, the hooks 40 are resilient, so that when the strings 46 are pulled, the hooks 40 will bend outwardly and downwardly to release the rings 44 and, hence, the gift 42; after which, the hooks 40 may be returned to their original positions for subsequent reuse. Finally, if desired, a plurality of pairs of holes 51 may be provided about the lid 14 with strings 53 laced through the holes 51 to allow additional gifts to be releasably tied on top of the lid 14.

In use, the pinata 10 is suspended from a ceiling or the like by hook 24 and strings 20 and the containers 30 are filled with candy or other suitable gifts. Additional gifts 42 may be suspended from hooks 40 on the sidewalls 16 of the housing 12, as seen in FIG. 3, with triggering means, such as strings 36 and 46 hanging downward from the trap doors 43 of the containers 30 and from the gifts 42 suspended from the hooks 40. The participant may then be blindfolded and may either be allowed to randomly select one of the strings 36 or 46 to pull, or someone may guide the participant to a selected one of the strings 36 or 42. In any event, if the participant pulls one of the strings 36, the string 36 will trigger a respective one of the trap doors 32 and will release the contents of the corresponding one of the containers 30. Alternatively, if the participant pulls one of the strings 46, the string 46 will cause the ring 44 to pull the hook 40 outwardly and downwardly to release the gift 42 which is suspended from the hook 40.

Figure 4:
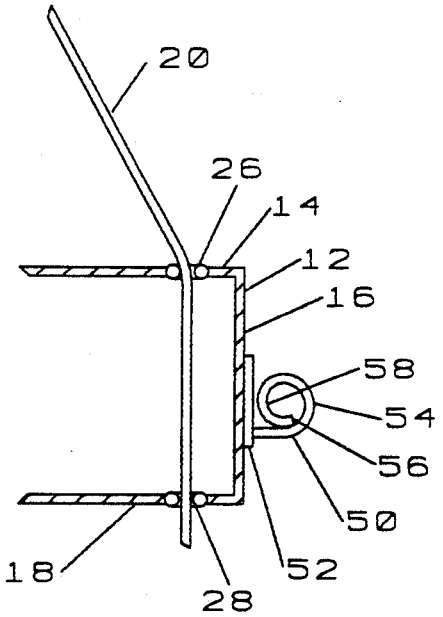
FIG. 4 is a side view of an alternative form of latch means for releasably retaining a gift on the exterior of the pinata of FIG. 1.
Figure 5:
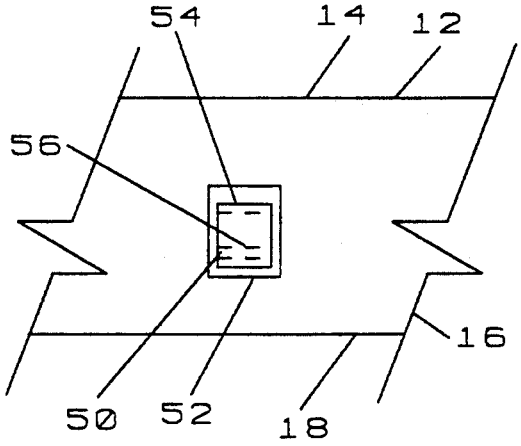
FIG. 5 is a front view of the latch means of FIG. 4.

FIGS. 4 and 5 show an alternative form of hook 50, which may be used in place of the hooks 40 on the sidewall 16 of the housing 12, of the material of the sidewall 16 is not sufficiently resilient to allow the hooks 40 to return to their original positions, after use. The hooks 50 are formed of resilient material, such as plastic, and have a base portion 52 for fixed attachment to the sidewall 16, as by a suitable adhesive, not shown, and have a hook portion 54 which curls through approximately 380°, so that the free end 56 overlaps its attachment to the base portion 52, as seen at 58 in FIG. 4. To suspend a gift 42 from the hook 50, the user simply slides the ring 44 over the free end 56 of the hook 50 to allow the hook portion 54 to support the string 46 and gift 42. When a participant pulls on the string 46, the ring 44 applies downward pressure to the hook portion 54, which simply uncurls to release the ring 44 and, hence, the gift 42. When the ring 44 slides off of the free end 56, the hook portion 54 recurls in readiness for subsequent use.

Obviously numerous other variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A pinata comprising:

a housing having a top, a bottom and an exterior wall enclosing at least two compartments formed by walls, contained within the housing to releasably retain a quantity of articles, trap door means releasably closing a bottom of each of said compartments and actuable to release the contents of said compartments, and a plurality of resilient latch means disposed about said exterior wall of said housing and individually dependent pull means to selectably release an article retained by the respective latch means.

2. The pinata of claim 1 wherein:

said housing contains a plurality of said compartments, each having a trap door to release articles from the respective compartment.

3. The pinata of claim 1 further comprising:

a first plurality of triggering means each hanging from a respective one of said trap doors and serving to open said respective one of said trap doors, and said dependent pull means each serving to attach an article to a respecting one of said latch means and operable to actuate said latch means to release said article.

4. The pinata of claim 1 further comprising:

said housing comprises a top formed with a plurality of openings, a sidewall and a bottom; and suspension means for hanging said pinata from a structure and including a plurality of strings each passing through a respective one of said openings and being secured to said bottom.

5. The pinata of claim 1 wherein:

said latch means are formed of resilient plastic having a base portion fixedly secured to said housing and having a hook portion with a free end which curls so that it overlaps its attachment to said base portion.

6. The pinata of claim 1 wherein:

said latch means are hooks formed by cuts made in said housing.

7. The pinata of claim 6 wherein:

said cuts are formed with a central projection having a shouldered portion extending from at least one side of said central projection.

8. The pinata of claim 1 further comprising:

a lid on said housing, and at least one opening in said lid having a string mounted therein to allow a gift to be releasably secured to said lid.

* * * * *